United States Patent [19]

Chung

[11] Patent Number: 5,030,146

[45] Date of Patent: Jul. 9, 1991

[54] MOUNTING STRUCTURE OF A PROPULSION DEVICE FOR AN INFLATABLE BOAT

[75] Inventor: Wang C. Chung, Taipei, Taiwan

[73] Assignee: Team Worldwide Corporation, Taipei, Taiwan

[21] Appl. No.: 479,159

[22] Filed: Feb. 13, 1990

[51] Int. Cl.[5] ..... B63B 7/08

[52] U.S. Cl. ..... 440/54; 114/345

[58] Field of Search ..... 440/49, 53, 54, 71, 440/111, 112; 114/343, 345, 346; 441/35, 41

[56] References Cited

U.S. PATENT DOCUMENTS

| | | | |
|---|---|---|---|
| 1,204,895 | 11/1916 | Michel | 440/54 |
| 2,302,795 | 11/1942 | Noble | 440/54 |
| 2,682,854 | 7/1954 | Cohen | 440/54 |
| 3,807,347 | 4/1974 | Baldwin | 440/54 |
| 4,021,873 | 5/1977 | Francois | 114/345 |
| 4,075,971 | 2/1978 | Reginensi | 440/54 |
| 4,913,074 | 4/1990 | Nishino | 440/54 |
| 4,942,838 | 7/1990 | Boyer | 114/345 |

*Primary Examiner*—Joseph F. Peters, Jr.
*Assistant Examiner*—Clifford T. Bartz
*Attorney, Agent, or Firm*—James R. Longacre; John M. White

[57] ABSTRACT

Disclosed is a mounting structure of a propulsion device for an inflatable boat, including a propulsion assembly, which comprises a power device and a driven propeller; a sleeve body, whose internal diameter is larger than the longitudinal length of the propeller of the propulsion assembly so as to allow the easy passage of the propeller of the propulsion device through the sleeve body; a mounting hole securely devised in the hull, the hole being provided near the stern of the inflatable boat in accordance with the habitual practice as well as for convenience sake, and the internal diameter being larger than the external diameter of the sleeve body; a power device supporting element, which is secured to the sleeve body so that when the propeller of the propulsion assembly passes through the sleeve body it can maintain the power device of the propulsion assembly above the flange of the cover of the sleeve body; and a set of direction control levers to turn the propeller of the propulsion assembly so as to control the direction of the boat; when the sleeve body passes through the mounting hole, the hull is inflated to tightly hold and secure the sleeve body.

14 Claims, 16 Drawing Sheets

MOUNTING STRUCTURE OF A PROPULSION DEVICE FOR AN INFLATABLE BOAT

BACKGROUND OF THE INVENTION

The present invention relates to a mounting structure of a propulsion device for an inflatable boat and particularly, to a mounting structure of a propulsion device installed at the bow of an inflatable boat.

Because of its portability, the inflatable boat is very popular among boating lovers. In general, the inflatable boat can be propelled in two ways: one is by rowing; the other is by installing a propulsion device at the stern of the boat, which is steered by the boater. One of the ways to mount a propulsion device at the stern used currently is shown in FIG. 1; the whole propulsion device 100 is pivotally mounted to a rigid frame 102, which in turn is anchored to a hull 104. The boater usually sits sideway in the boat, his hand holding a steering handle 101 to control the direction and movement of the boat. Another way of mounting a propulsion device 100 is illustrated in FIG. 2. A link 100*a* is detachably made to pass through channel 105 of the hull 104, and the boater steers the boat in the same way as in the first stance. Both conventional ways of mounting the propulsion device mentioned above have the following drawbacks:

(a) The boater has to sit sideway and thus cannot pay attention to the sides while the boat is moving.

(b) The direction of the movement of the steering handle is just opposite to that of the boat; it takes a beginner quite a long time to adjust to this.

(c) The mounting method as shown in FIG. 2 is only suitable for boats wherein the motor 100*b* directly moves the propeller 100*c*. If the propeller 100*c* is driven by an engine through a power transmission shaft 100*d* (see FIG. 1), the strength will be weakened due to the fact that the power transmission shaft and the exhaust pipe are detachably assembled; in addition, it is very inconvenient to install, and hence unfit for this mounting method.

SUMMARY OF THE INVENTION

In view of the drawbacks of these conventional methods of mounting the propulsion device to an inflatable boat stated above, the inventor of the present invention offers a structure of mounting a propulsion device at the bow. With the present invention, the boater can sit comfortably in the center of the boat and keep an eye on both sides of the boat, thus increasing the degree of safety and in keeping with the habit of steering in the front seat.

Another object of the present invention is to offer a mounting structure of a propulsion device for an inflatable boat, through which the propulsion device can be speedily and conveniently mounted onto or dismounted from the boat.

Still another object of the present invention is to provide a mounting structure of a propulsion device for an inflatable boat to prevent the propeller from being struck while the boat is moving, and through which to enhance the safety of boating.

A further object of the present invention is to provide a mounting structure capable of cooling the exhaust pipe of the propulsion device of an inflatable boat.

Another further object of the present invention is to offer a mounting structure of a propulsion device for an inflatable boat which will not float too far away from the boater when he jumps into the water.

Still another further object of the present invention is to offer a mounting structure of a propulsion device for an inflatable boat capable of using the direction of water displaced by the propeller to steer the boat.

The mounting structure of the present invention comprises:

a propulsion assembly, including a power device and a driven propeller;

a sleeve body, the internal diameter of which is greater than the longitudinal length of the propeller of the propulsion assembly so that the propeller of the propulsion device can directly pass through the sleeve body from one end;

a mounting hole, which is devised near the bow of the inflatable boat, and whose internal diameter is larger than the external diameter of the sleeve body.

a power device supporting means, which secures firmly to the sleeve body so that when the propeller of the propulsion assembly passes through the sleeve body, it can stay on the upper edge of the flange; and a set of direction control levers, which swing the propeller of the propulsion assembly so as to control the direction of the boat;

When the sleeve body is inserted through the mounting hole, the air chambers of the hull have to be inflated to tightly hold and secure the sleeve body.

BRIEF DESCRIPTION OF THE DRAWINGS

The present invention can be more fully understood with reference to the following description and accompanying drawings, which form an integral part of the present invention.

DETAILED DESCRIPTION OF THE PREFERRED EMBODIMENTS

Figure 1:
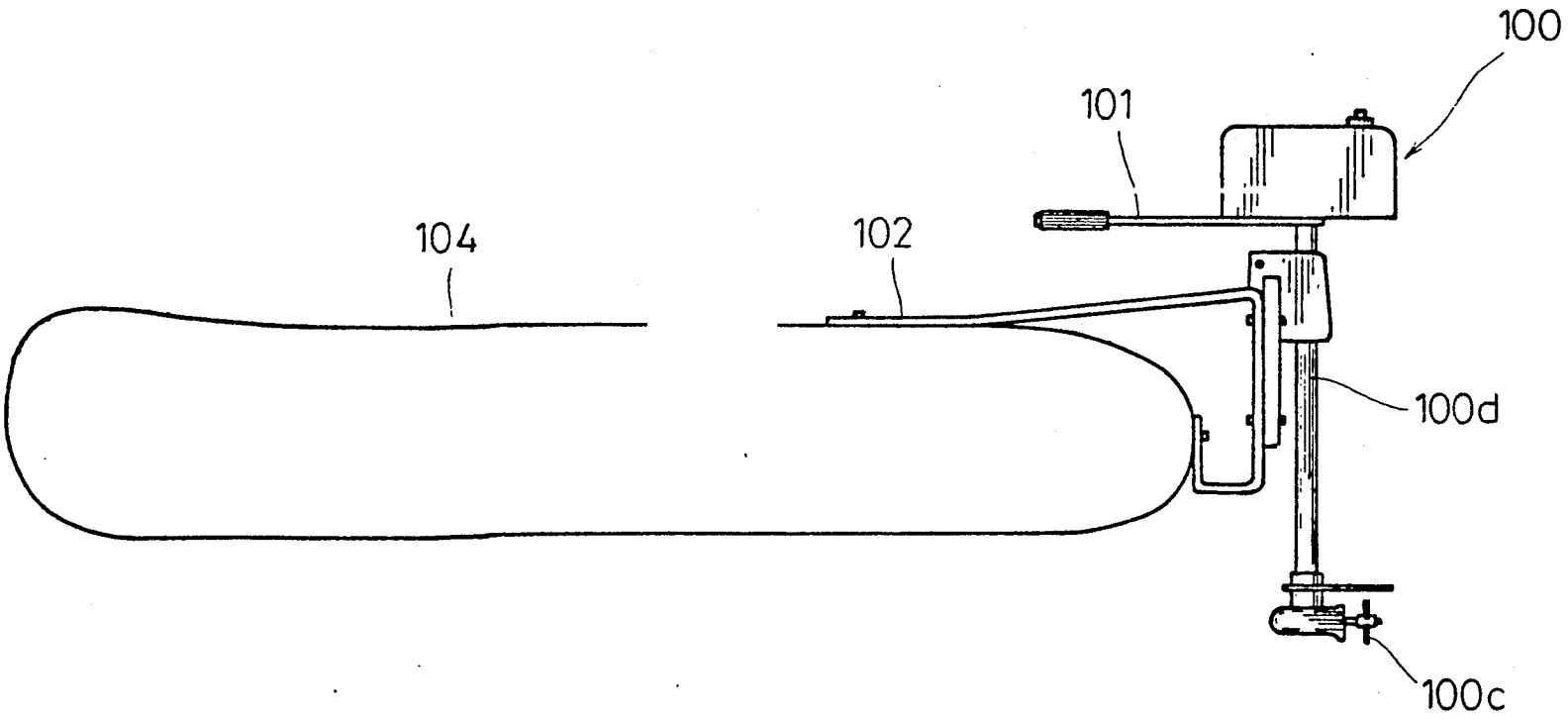
FIG. 1 and FIG. 2 are illustrations of the structure of mounting a propulsion device to the stern of an inflatable boat practised conventionally.
Figure 2:
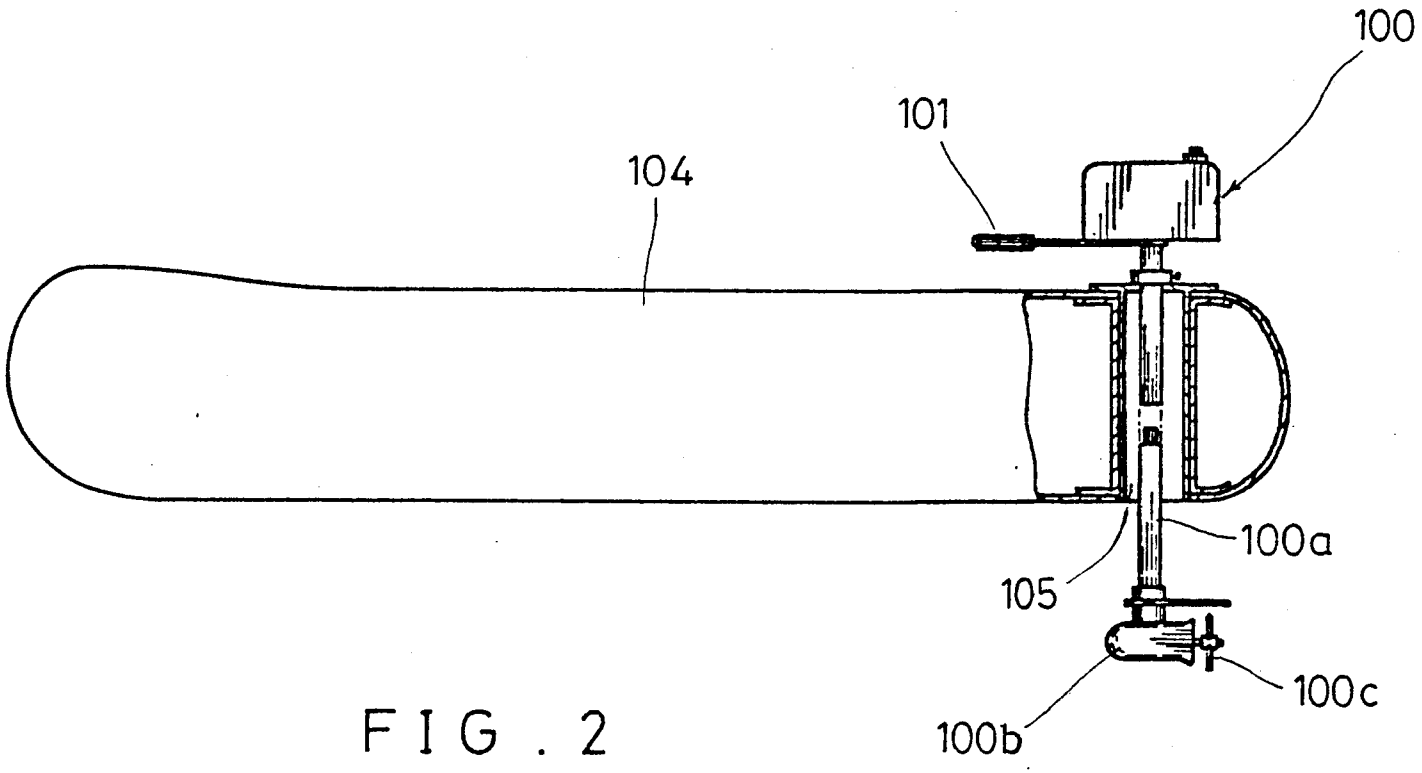
Figure 3:
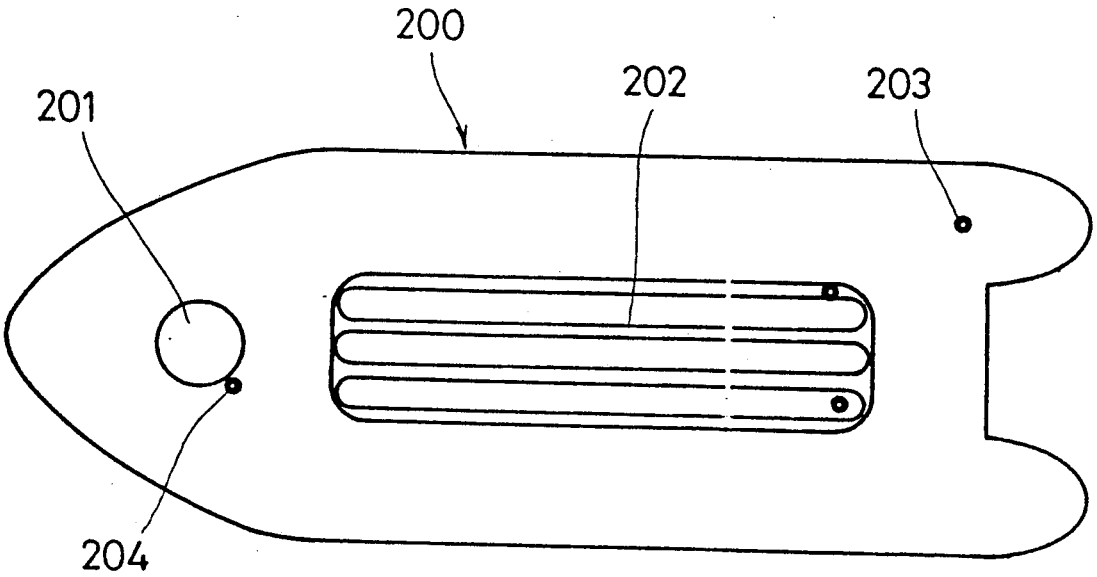
FIG. 3 and FIG. 4 are respectively a top plan view and a partial sectional view of the first preferred embodiment of an inflatable boat fitted with a propulsion device at the bow.
Figure 4:
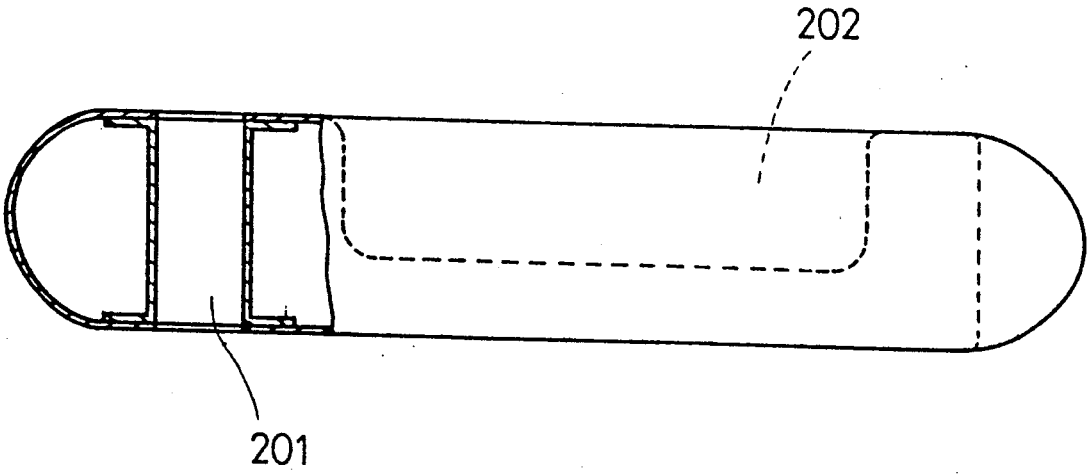

As shown in FIG. 3 and FIG. 4, the bow of a hull 200 suitable for the mounting structure of the present invention is provided with a mounting hole 201 of a propulsion device; by means of the physical action of inflation a sleeve body (not shown) surrounding the propulsion device is secured (to be discussed hereinbelow). The boater sits in a seat 202.

Figure 5:
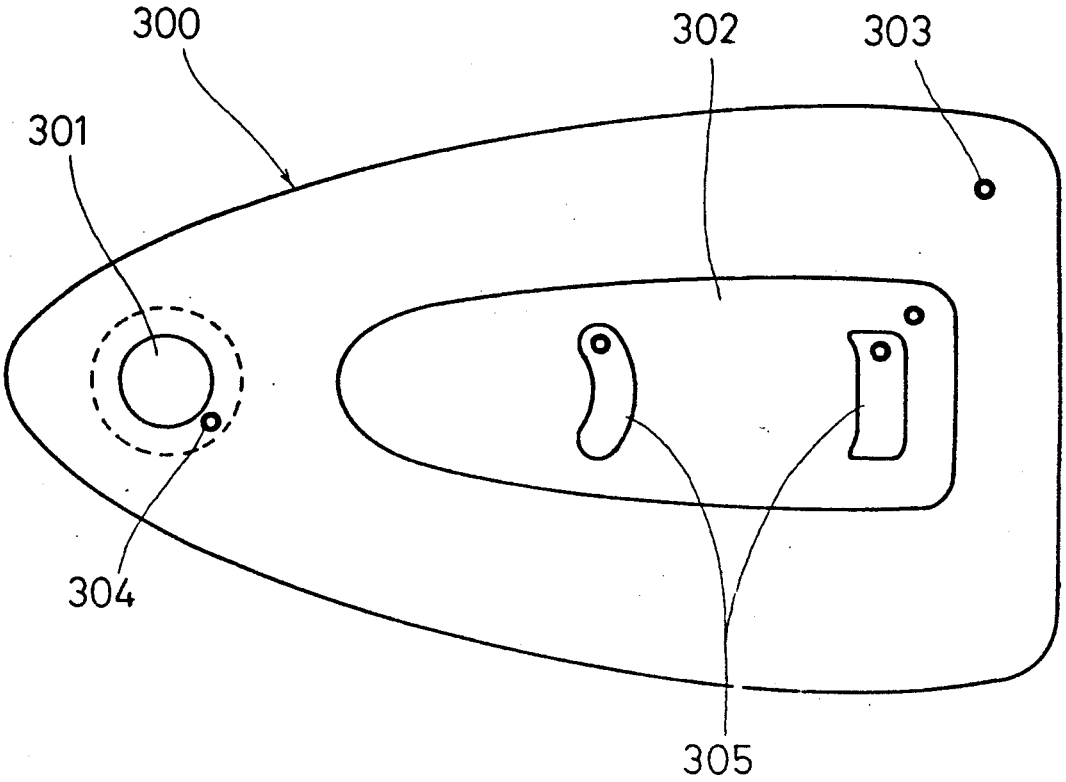
FIG. 5 and FIG. 6 are respectively a top plan view and a partial sectional view of the second preferred embodiment of an inflatable boat fitted with a propulsion device at the bow.
Figure 6:
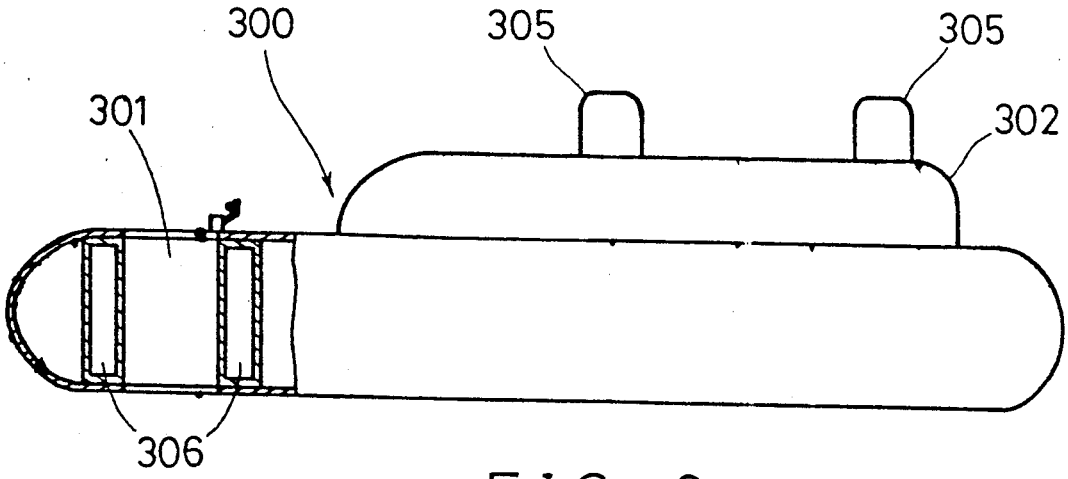

FIG. 5 and FIG. 6 show another kind of boat structure. The bow of a hull 300 is provided with a mounting hole 301, the internal hole of which has isolated air chambers 306 surrounding it to enhance safety and to protect the propulsion assembly from damage by water once the hull leaks. The difference between the hull 300 herein described and the hull 200 mentioned in FIG. 3 and FIG. 4 is that a seat 302 is positioned above the hull 300 and a back is also provided for the sake of comfort.

Figure 7:
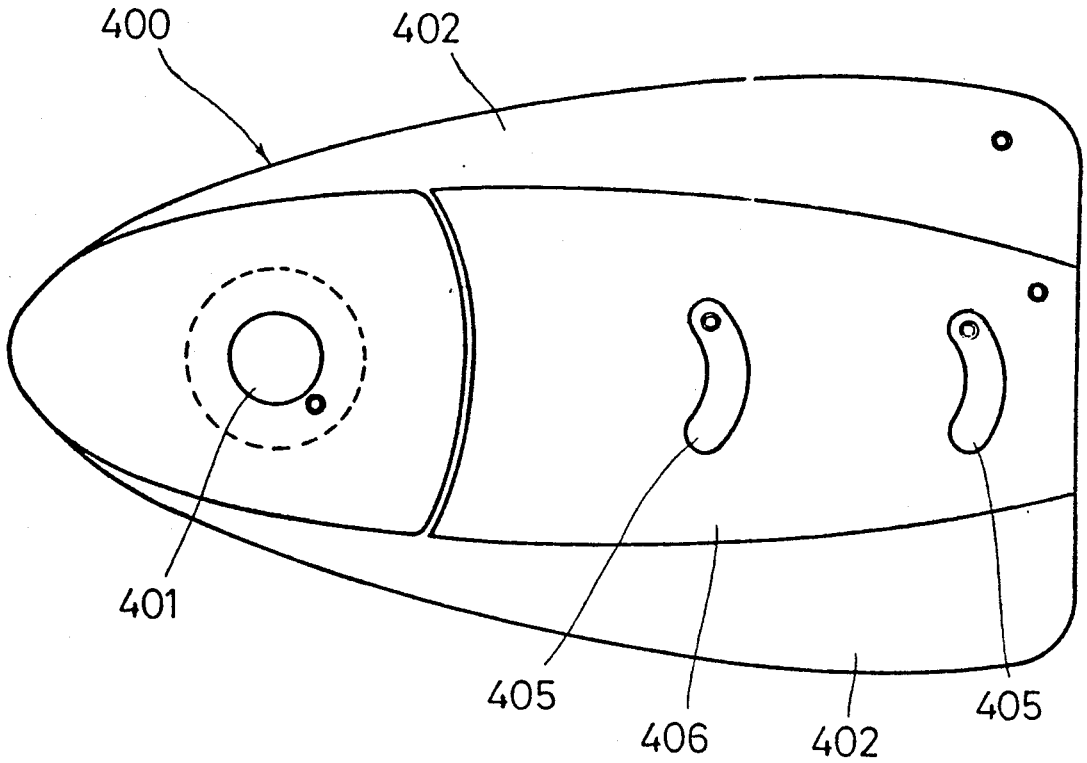
FIG. 7 and FIG. 8 are respectively a top plan view and a partial sectional view of the third preferred embodiment of an inflatable boat fitted with a propulsion device at the bow.
Figure 8:
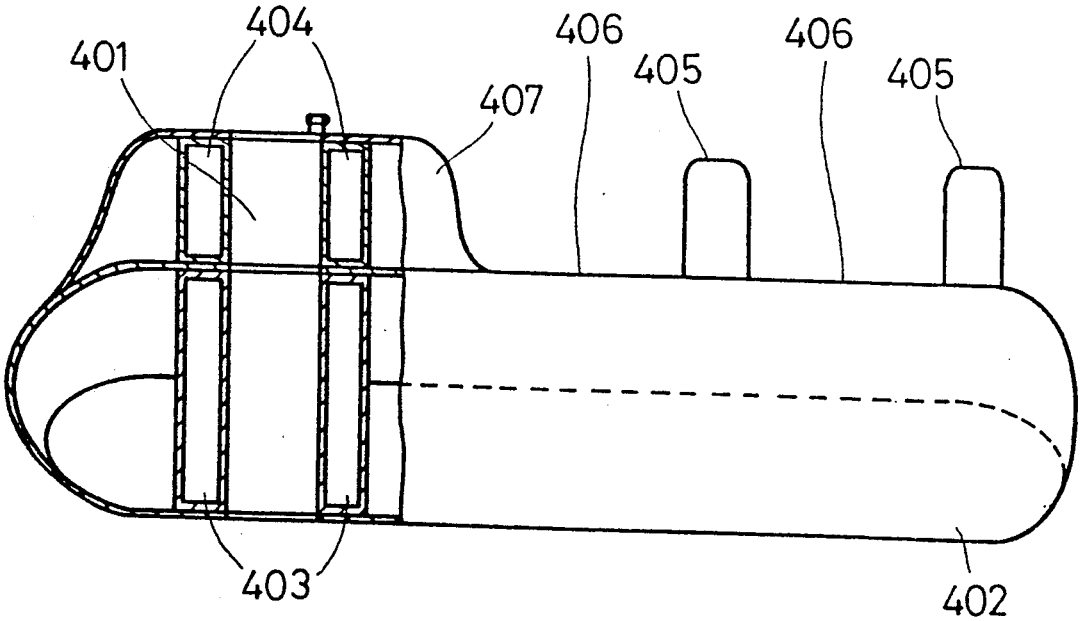

FIG. 7 and FIG. 8 illustrate still another kind of boat structure. The bow 407 of a hull 400 swells up and has a mounting hole 401 in the center. Enveloping the internal hole of the mounting hole 401 are separate air chambers 403, 404. On the hull 400 is devised seats 406 and backs 405; the rider can rest his feet on fins 402.

Figure 9:
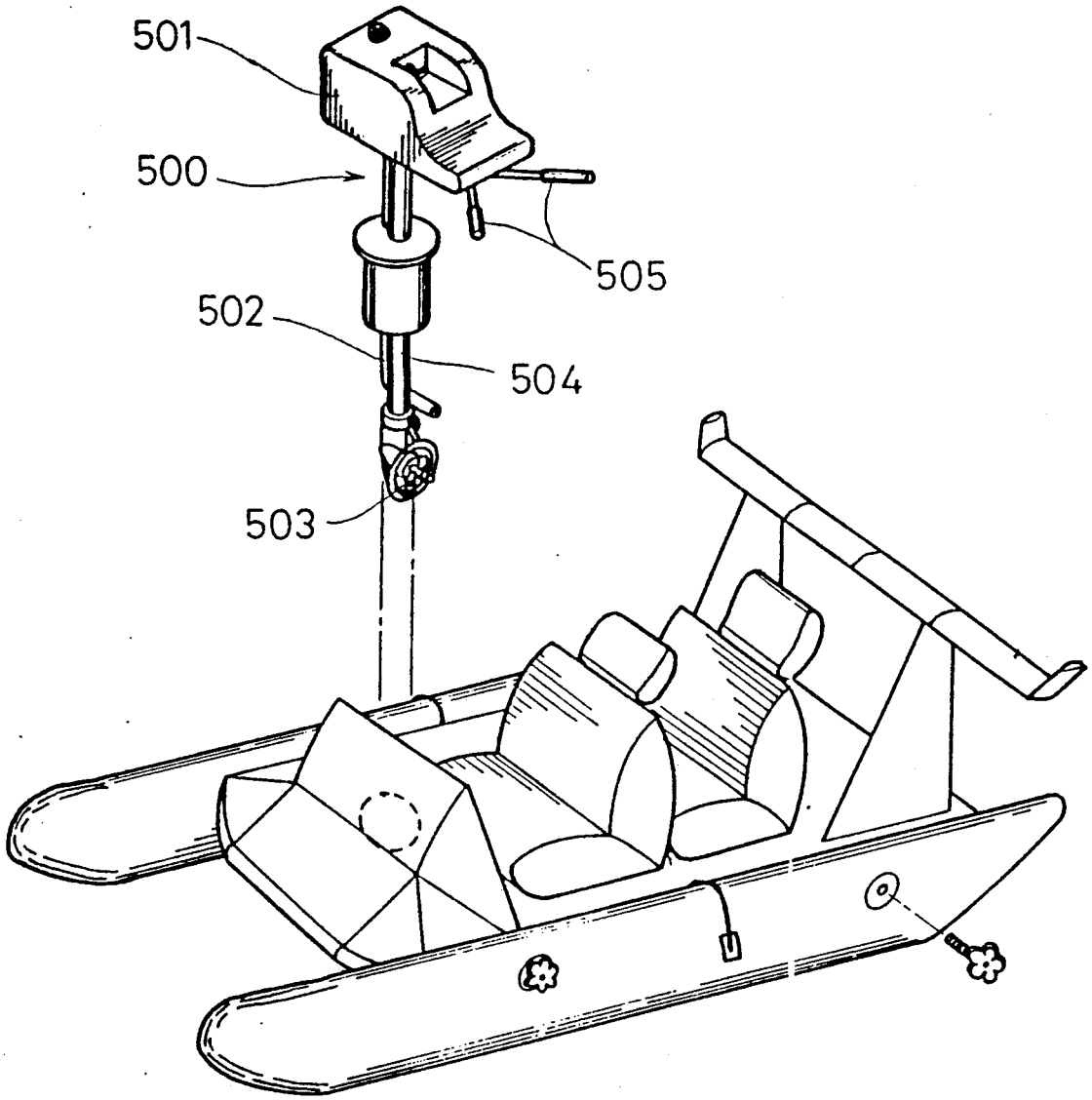
FIG. 9 is a perspective view of the hull and the propulsion device of the present invention.
Figure 10A:
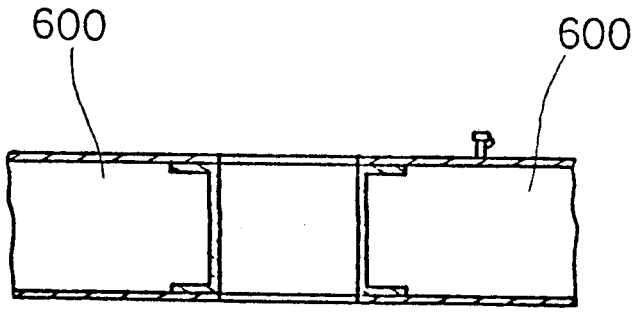
FIG. 10 through FIG. 13 are longitudinal sectional views of the mounting hole of an inflatable boat provided in the mounting structure of the propulsion device of the present invention.
Figure 13A:
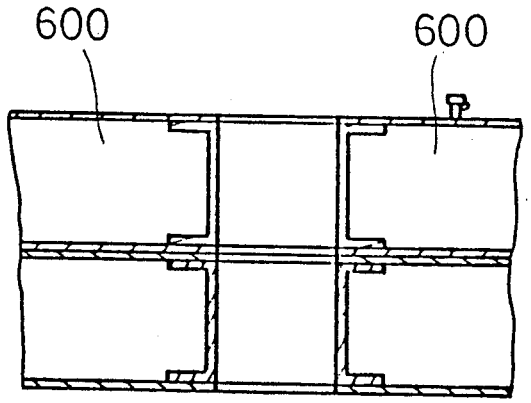
Figure 10B:
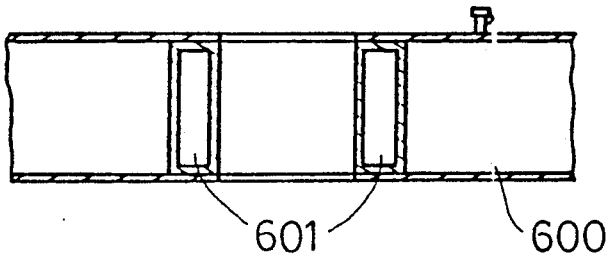
Figure 11:
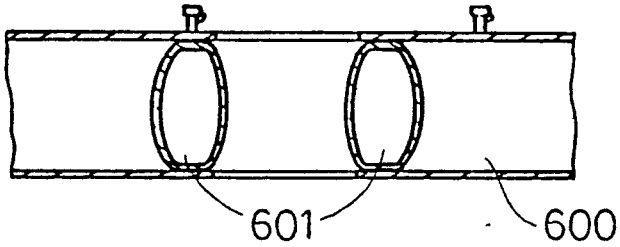
Figure 12:
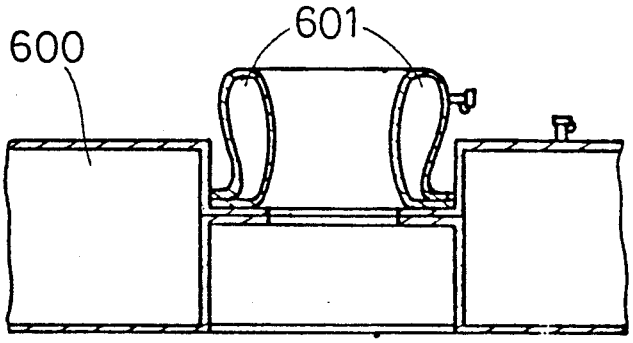
Figure 13B:
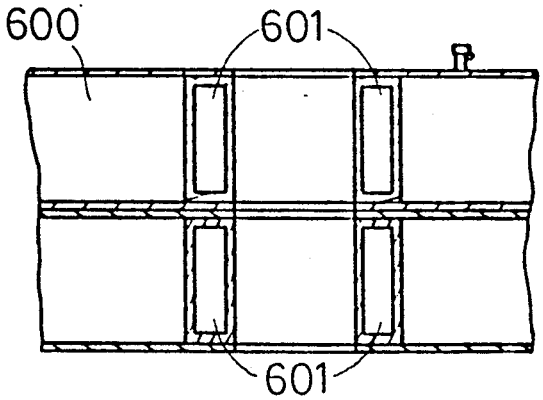

FIG. 9 is the perspective view of the structure of a propulsion device 500 adaptable for the present invention and the hull. An engine 501 drives a power transmission shaft 504 and, through the power transmission mechanism (not shown), drives a propeller 503. Exhaust from the engine 501 passes through an exhaust pipe 502 and is discharged into the water. With both hands holding the direction control levers, the boater can operate the propeller 503 so as to steer the boat. Further, the sleeve body is connected to the propulsion device by tenon jointing, and the propulsion device has a protective cover.

FIG. 10 through FIG. 13 respectively show the structure of the mounting hole 301 at the bow and its isolated chambers, wherein the hull is marked 600 and the isolated air chamber 601.

Figure 14:
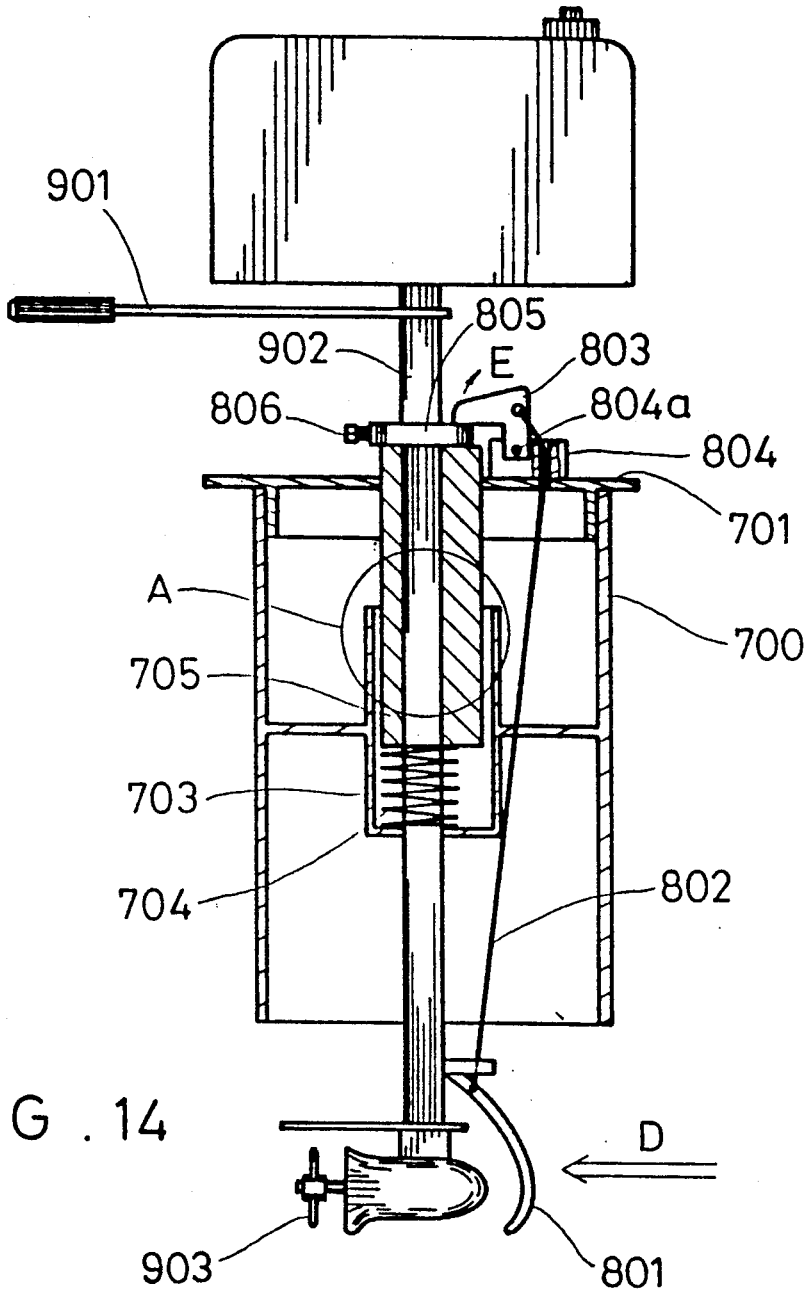
FIG. 14 is a schematic view of the propeller's protective cover and the deviation mechanism of the mounting structure of the propulsion device.

FIG. 14 shows the mounting structure of the propulsion device with a propeller protective cover 801.

Figure 15:
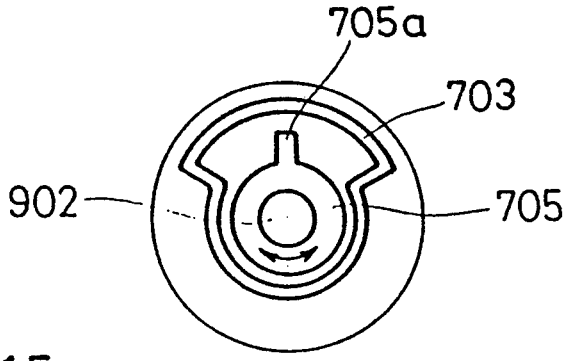
FIG. 15 is a cross-sectional schematic view of the part A in FIG. 14.
Figure 16:
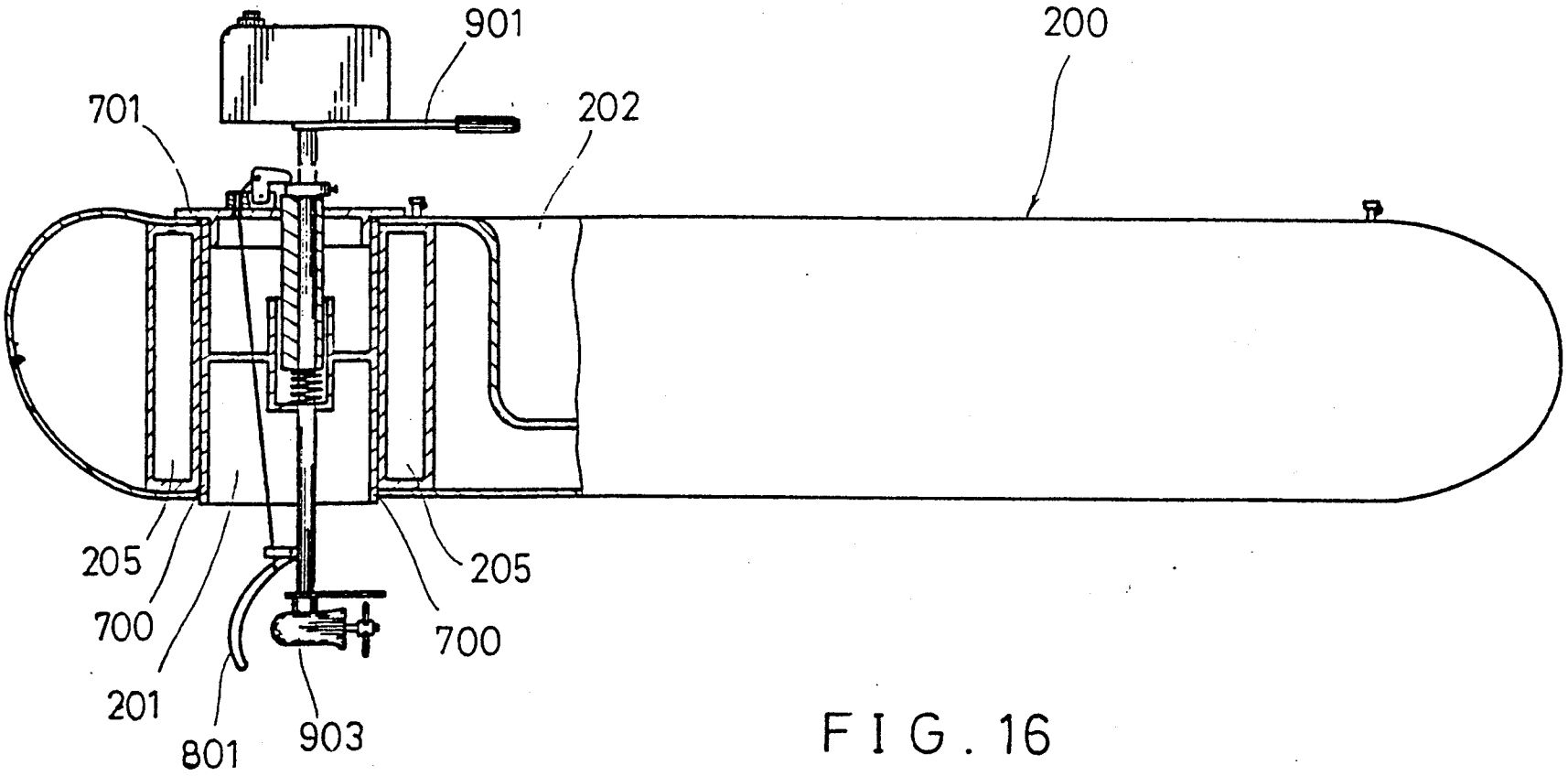
FIG. 16 is a partial sectional view of the inflatable boat mounted with the propulsion device in FIG. 14.

FIG. 16 illustrates the hull shown in FIG. 4 fitted with the propulsion assembly in FIG. 14. Reference is now made to FIGS. 14–16 to illustrate the operation of the propulsion device and the function of the propeller protective cover. As shown in FIG. 16, a sleeve body 700 is fitted into a mounting hole 201. When the air chambers are inflated, the expansion action forces the sleeve body 700 to be held tightly within the mounting hole 201. The most convenient method of installation is to inflate the hull first and then put the sleeve body and the propulsion device in the last isolated air chamber for inflation. By means of a cover 701, the propulsion device can be assembled and devised on the sleeve body. The boater can then sit in a seat 202, holding the direction control lever 901 to steer the boat. Furthemore, please refer to FIG. 14, the sleeve body 700 has in its center a portion of a fan-shaped limiting element 703 (please refer to FIG. 15), and the power transmission shaft 902 is externally provided with a sleeve 705 having a rib 705*a*. The sleeve 705 and the power transmission shaft 902 are integrally fitted into the limiting element 703. A spring 704 is provided in between the limiting element 703 and the sleeve 705. The function of the spring 704 is to push the sleeve 705 upward, simultaneously exerting a twisting force on the power transmission shaft; i.e. when the boater releases the direction control lever 901, the spring 704 will make the propeller 903 slant to one side so that the hull keeps on circling and will not stray away. Further, the upper edge of the sleeve 705 has a flange 805 riveted to the power transmission shaft 902 by means of a screw 806. Pressed against the upper end of the flange 805 is a hook 803, which is supported on the pivotal point 804*a* of the hook seat 804. A link 802 connects the hook 803 and the propeller protective cover 801. When the propeller protective cover 801 is struck by rocks underwater and turns in the direction of arrow D, it will drive the link 802 and further move the hook 803 so that the hook 803 turns in the direction of arrow E and is thus disengaged from the flange 805. At this time, the spring 804 will push the power transmission shaft upward, moving the propeller 903 upward too, so that the propeller 903 can avoid being hit and damaged.

FIG. 15 shows the revolving motion of the power transmission shaft 902 within the limiting element 803. As its movement is restricted by the limiting element 703, the rib 705*a* can only rotate within a limited range of degrees.

Figure 17:
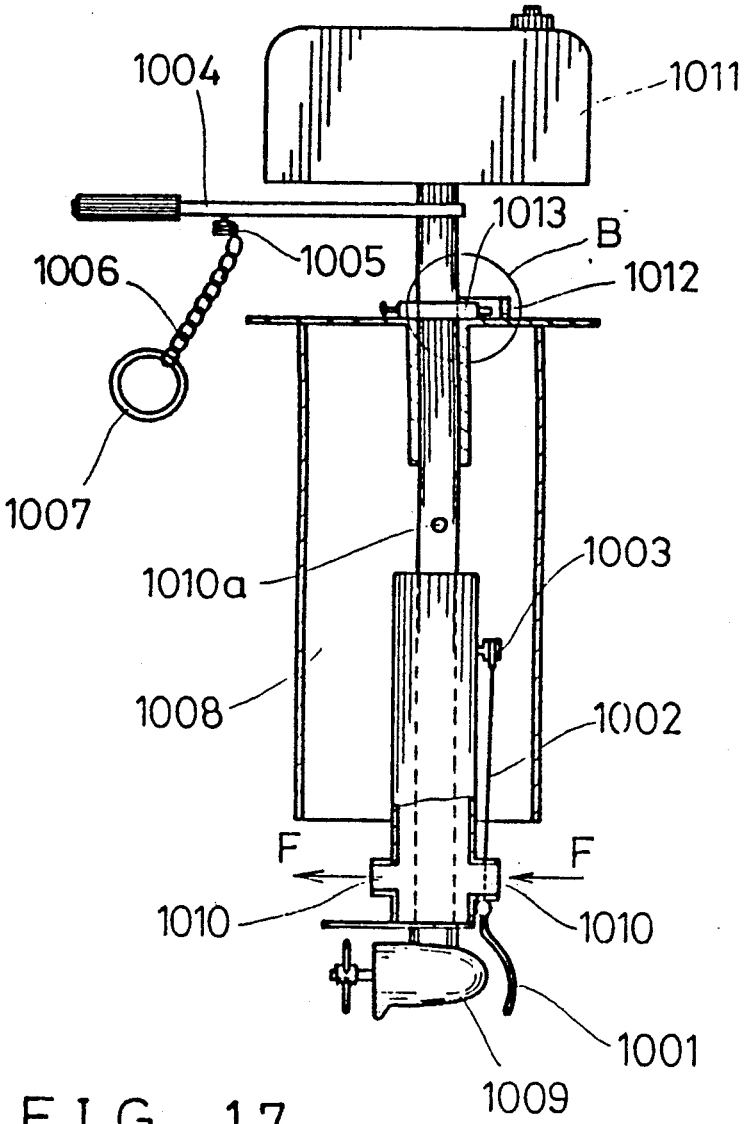
FIG. 17 is a schematic view of the mounting structure of the propulsion device fitted with a fire extinguishing device against possible sinking and striking.
Figure 18:
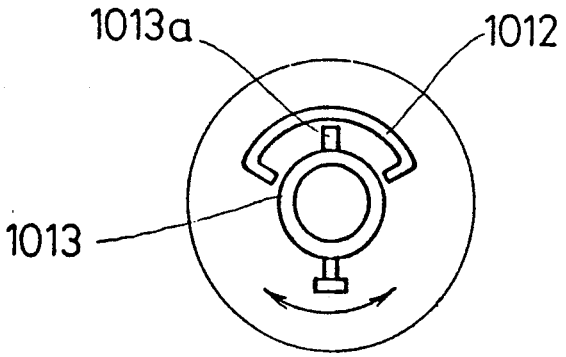
FIG. 18 is a cross-sectional schematic view of the part B in FIG. 17.

FIG. 17 shows the structure of the propeller protective cover 1001 and the fire extinguishing device in accordance with the mounting structure of the propulsion device of the present invention. FIG. 18 is a cross-sectional view of the limiting element of the propulsion device shown in FIG. 17 on an enlarged scale. As can be seen from FIG. 17, the propeller protective cover 1001 will drive the link 1002 when it hits an object. It will further cut off the contact point 1003 at one end of the link 1002 to stop the hull from moving and to prevent the propeller from being hit. Furthermore, the contact point 1005 on the direction control lever can link to a loop 1007 by means of a chain 1006. The loop 1007 can be slipped onto the hand of the boater. In case the boater accidentally falls into the water, the contact point 1005 will be cut off in response to the violent pulling on the loop; hence, the hull will also stop. As a general rule, it is difficult to start the engine 1011 since the exhaust hole is immersed in water; therefore, at a position above water level an opening 1010*a* is devised in the exhaust pipe situated in the space 1008 of the sleeve body. When the engine is started, part of the exhaust will accumulate in the space 1008, and when the boat is moving, water close by the opening 1010 near the propeller will move in the direction of F and carry the exhaust out of the space 1008.

Figure 19:
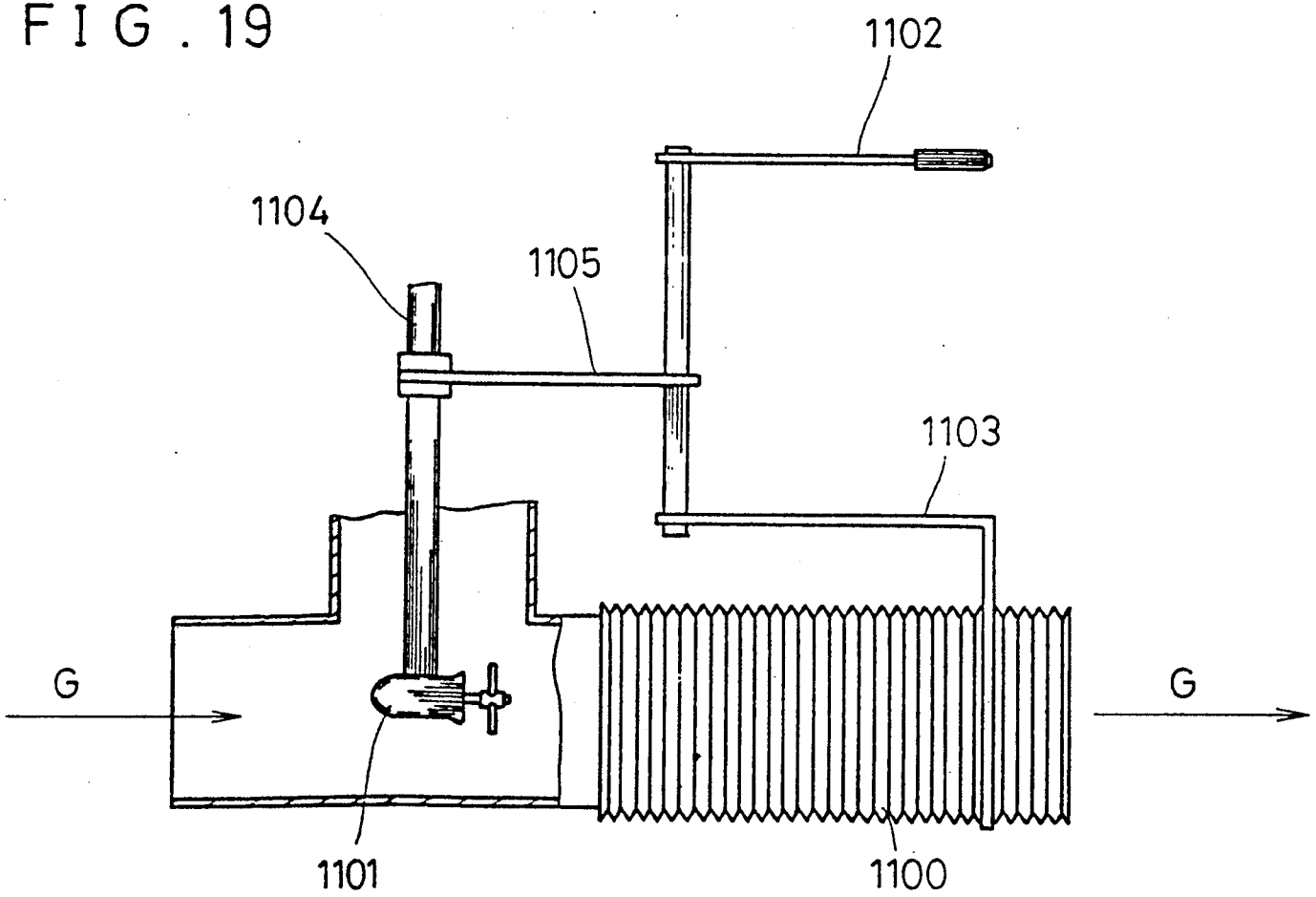
FIG. 19 is a schematic view of the mechanism of using the direction of water displaced by the propeller to control the direction of the boat.

FIG. 19 illustrates another embodiment of the steering device of the mounting structure of the propulsion device of the present invention. As seen from FIG. 19, the direction control lever is pivoted upon a frame 1105 secured to the power transmission shaft 1104. By means of the rotation of a direction control lever 1102, a bellow pipe 1100 secured to a link 1103 can also be driven. Water flows from the front of the propeller 1103 in the direction of G and passes by the propeller 1101 into the bellow pipe 1100 again. Controlling the direction of water flow near the outlet of the bellow pipe 1100 can manipulate the direction of the boat's movement. Therefore, turning the direction control lever can control the direction of the boat.

Figure 20:
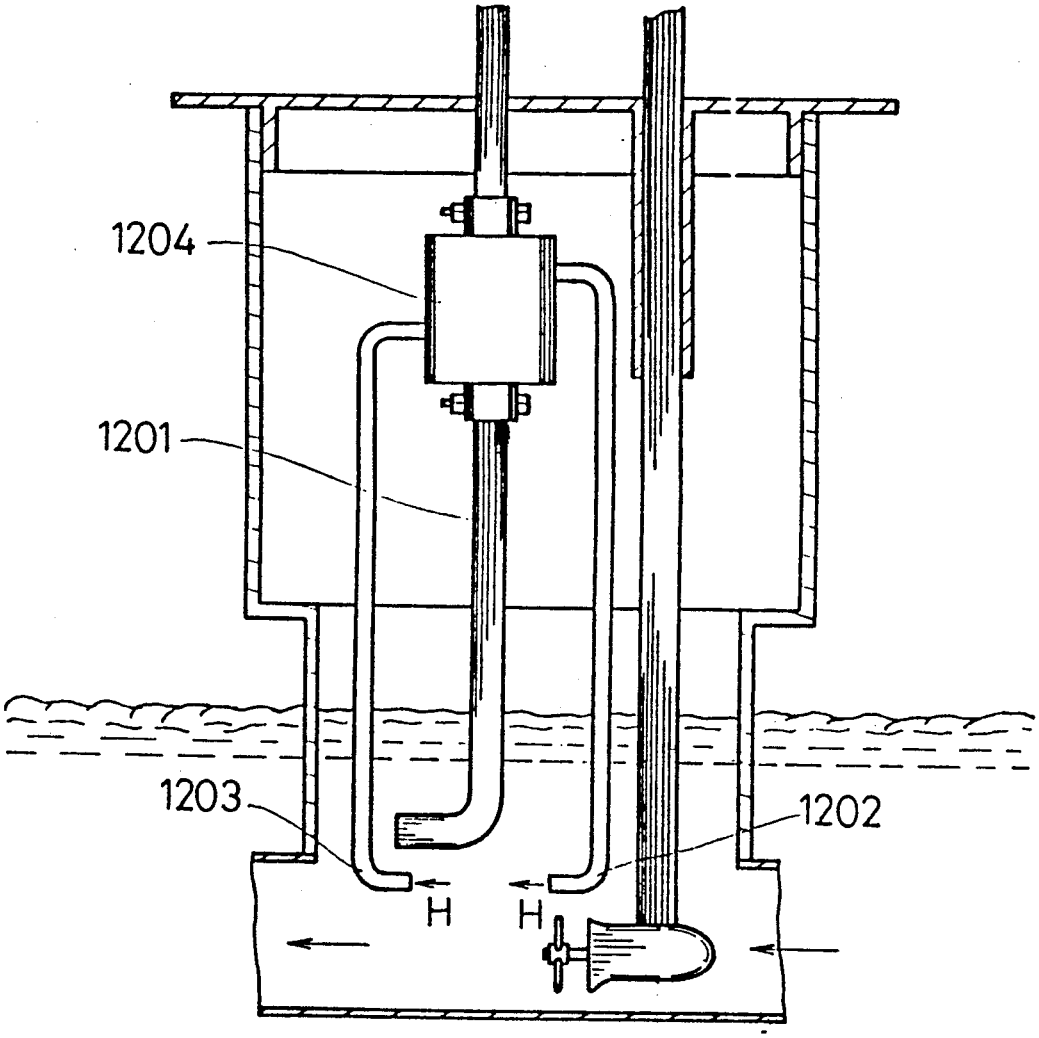
FIG. 20 is a schematic view of the structure of the cooling device of the exhaust pipe of the propulsion device.

FIG. 20 shows a preferred embodiment of the cooling device in the exhaust pipe of the mounting structure of the propulsion device according to the present invention. As can be observed from FIG. 20, the upper portion of the exhaust pipe 1201 has a cooling box 1204, which is provided with an outlet pipe 1203 and an inlet pipe 1202. When the boat moves, water flows in and out of the inlet 1202 and outlet 1203 in the direction of arrow H, carrying away the hot water in the exhaust pipe 1201; this design can prevent the mounting structure of the propulsion device and the hull from wear or damage as a result of constant contact with the hot exhaust gas from the engine.

Figure 21:
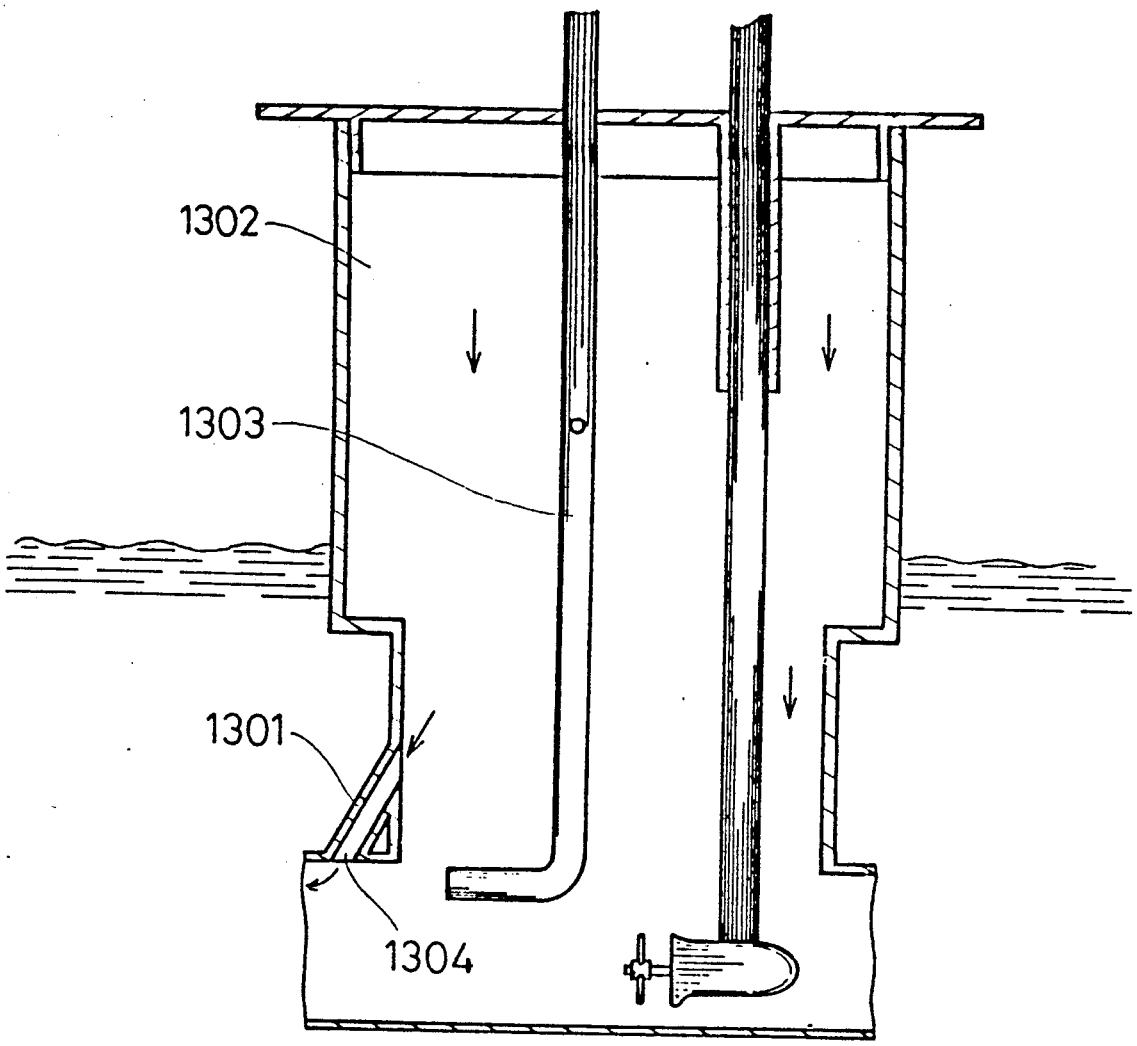
FIG. 21 is a schematic view of the mechanism of discharging exhaust from the engine and strengthening the exhaust hole in the mounting structure of the present invention.

FIG. 21 shows another preferred embodiment of the mechanism of discharging exhaust in the mounting structure of the present invention. Exhaust accumulated in the space 1302 is discharged through a manifold pipe 1301. Because water near the outlet 1304 of the manifold pipe 1301 creats a negative pressure, the exhaust is sucked out.

Figure 22:
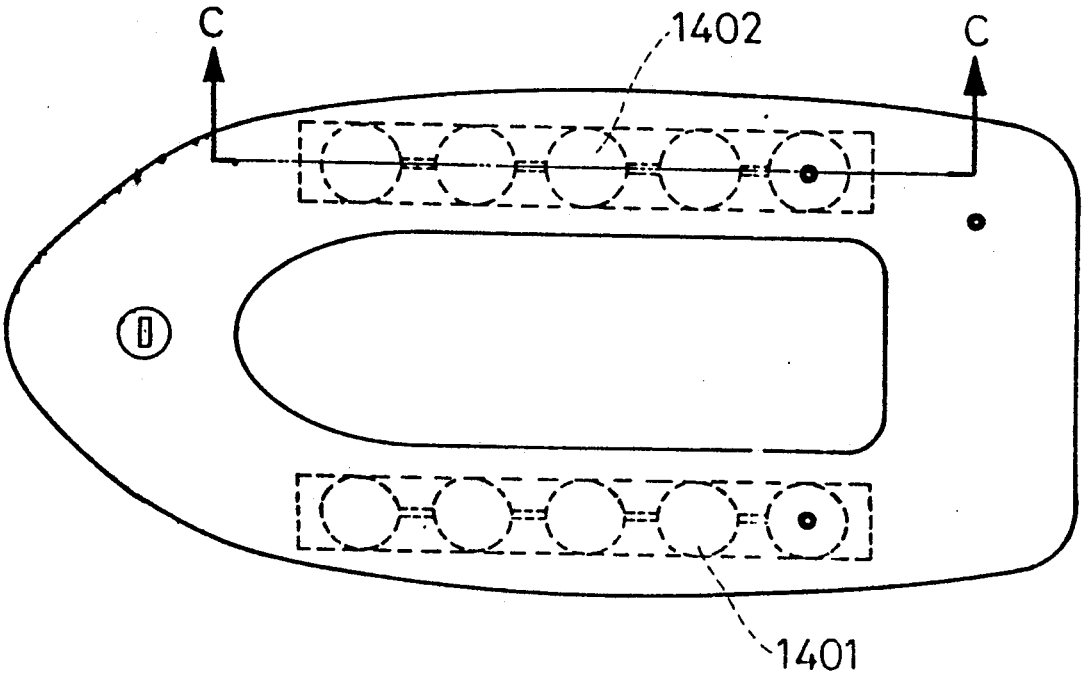
FIG. 22 is a bottom elevational view of the air chambers of the inflatable boat.

FIG. 22 is the bottom view of the the hull. As shown in FIG. 22, the bottom of the boat has two isolated air chambers 1401 and 1402. When a part of the boat is cut by some unknown object, the boat will not sink or the sinking can be delayed due to the existence of the two air chambers of 1401 and 1402.

Figure 23:
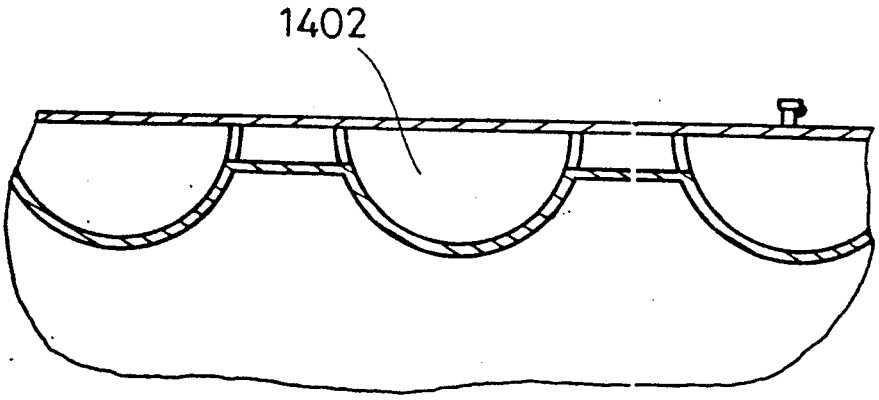
FIG. 23 is a sectional view along a line XXIII—XXIII in FIG. 22.
Figure 24:
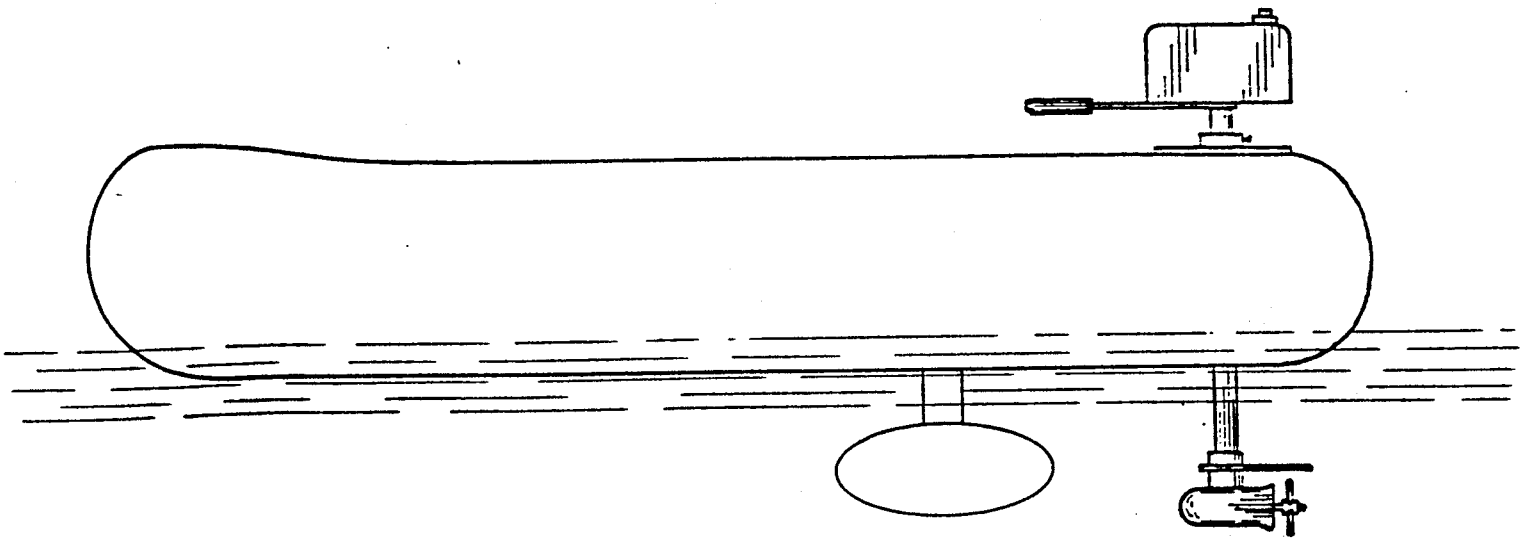
FIG. 24 is a simplified diagram showing the operation of an inflatable with a stabilizing fin.

FIG. 23 is the sectional view of FIG. 22 along the line XXIII—XXIII. It shows the structure of the isolated air chamber 1402.

As mentioned hereinabove, the mounting structure of the propulsion device according to the present invention can be fitted at the bow of an inflatable boat so that the boater can sit in the center and comfortably steer the boat, while capable of attending to the safety of the both sides of the boat.

Furthermore, since it only requires the user to insert the propulsion assembly together with the sleeve body into the mounting hole at the stern and to inflate the air chambers around the hole, the installation is very easy as well as speedy, and the boat can be very secure too.

In addition, the mounting structure of the present invention is fitted with a device for preventing the propeller against possible striking, further enhancing the safety of boating.

While the invention has been described in terms of what are presently considered to be the most practical and preferred embodiments, it is to be undersstood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A mounting structure of a propulsion device and a steering control for an inflatable boat, comprising:

a propulsion assembly, which includes a power device and a mechanically driven propeller;

a shaft connecting said power device and said propeller, the upper portion of said shaft being supplied with a device capable of providing a perpendicular relationship between the shaft and the water surface;

a sleeve body, whose internal diameter is larger than the length of said propeller of said propulsion assembly so as to allow said propeller and said shaft of said propulsion assembly to directly pass through said sleeve body from one end to make said sleeve body form the supporting base for the propulsion mechanism;

a mounting hole for said sleeve body, said mounting hole being located within the inflatable boat and having an internal diameter larger than the external diameter of said sleeve body to facilitate the installation of said sleeve body said mounting hole having a top and a bottom;

a power device supporting element, said supporting element being incorporated with said sleeve body to keep the power device of said propulsion assembly above a line halfway between the top and bottom of said mounting hole and to prevent it from dropping, when said sleeve body together with said propeller of said propulsion assembly inserted therein is inserted into said mounting hole; and a direction control lever, provided to drive said propeller of said propulsion assembly so as to control the direction of the boat;

said sleeve body being inserted into said mounting hole, air chambers of said hull being inflated to secure said sleeve body within said mounting hole.

2. A mounting structure of a propulsion device for an inflatable boat as claimed in claim 1, wherein said mounting hole is disposed at the bow of the inflatable boat.

3. A mounting structure of a propulsion device for an inflatable boat as claimed in claim 1, wherein said mounting hole is disposed at the stern of the inflatable boat, and a device for reversing the turning direction of said propulsion assembly is provided to facilitate the steering of the inflatable boat.

4. A mounting structure of a propulsion device for an inflatable boat as claimed in claim 1, wherein said mounting structure further comprises a sleeve body cover, said cover is devised between said sleeve body and the propulsion mechanism to support said shaft.

5. A mounting structure of a propulsion device for an inflatable boat as claimed in claim 1, wherein said mounting structure further comprises a propeller protective device, said protective device including:

a protective cover, being devised to the front of said propeller in the same direction of the boat;

a link, having one end connected to said protective cover;

a hook, being connected to the other end of said link to clasp a fastener fastened to said propeller of said propulsion assembly; and a biasing means, provided to bias said propeller to push said propeller upward when said hook is detached from said fastener;

when said protective cover is struck, it can move said link so as to disengage said hook from said fastener.

6. A mounting structure of a propulsion device for an inflatable boat as claimed in claim 1, wherein said structure further includes a propeller protective device, said protective device comprising:

a protective cover, devised to the front of said propeller in the same direction of the boat;

a link, having one end connected to said protective cover; and a power switch of a power device, said switch being joined to the ignition means of said power device and being connected to another end of said link;

when said protective cover is struck, it can drive said link to cut off the ignition means of said power device.

7. A mounting structure of a propulsion device for an inflatable boat as claimed in claim 1, wherein said structure further comprises a deviation device, said deviation device comprising:

a biasing means, provided to bias said propeller so as to constantly push said propeller to a deviating direction when said direction control lever is not manipulated; and a limiting element, provided to limit the deviation angle of said propeller within a certain range.

8. A mounting structure of a propulsion device for an inflatable boat as claimed in claim 1, wherein said structure further comprises a fire extinguishing device, said extinguishing device including:

a power switch, said switch being connected to said power device of said propulsion assembly; and a looping means, having one end connected to said power switch and another end to the body of the boater;

when the boater falls into the water, said looping means will be detached from said power switch and the power supply of said power device is thus cut off.

9. A mounting structure of a propulsion device for an inflatable boat as claimed in claim 1, wherein said structure further comprises a bellow pipe provided at the back of said propeller, said bellow pipe having its opening connected to said direction control lever so as to control the direction of the boat.

10. A mounting structure of a propulsion device for an inflatable boat as claimed in claim 1, wherein said structure further comprises a cooling device in the exhaust pipe of the engine, said cooling device includes:

a cooling box provided externally around the exhaust pipe of the engine;

an inlet pipe, said inlet pipe being connected to said cooling box and having an opening under water and facing the direction of the boat; and an outlet pipe, said outlet pipe being connected to said cooling box and having an opening under water and facing a direction opposite to that of the boat.

11. A mounting structure of a propulsion device for an inflatable boat as claimed in claim 1, wherein said structure further comprises an exhaust discharge device in said sleeve body, said device includes:

a manifold pipe connected to the space in said sleeve body, said manifold pipe having an opening being devised at an appropriate position where said propeller creates a vacuum pressure in the water.

12. A mounting structure of a propulsion device for an inflatable boat as claimed in claim 1, wherein said structure further comprises a preventive device against sinking, said device being a plurality of isolated air chambers in the hull.

13. A mounting structure of a propulsion device for an inflatable boat structure as claimed in claim 1, wherein an isolated air chamber is located between the external fringe of the mounting hole of the hull and the hull itself, so as to facilitate the installation of said mounting structure of said propulsion device and said direction control device, and to protect said mounting structure against possible contact with water in case the boat leaks.

14. A mounting structure of a propulsion device for an inflatable boat as claimed in claim 1, wherein said structure is provided with a football-shaped stabilizing fin to stabilize the boat when it is moving.

* * * * *